US007137788B2

(12) United States Patent
Goodell

(10) Patent No.: US 7,137,788 B2
(45) Date of Patent: Nov. 21, 2006

(54) AIR COMPRESSOR OIL RECIRCULATION SYSTEM

(75) Inventor: David J. Goodell, Beaverton, OR (US)

(73) Assignee: Bendix Commercial Vehicle Systems LLC, Elyria, OH (US)

( * ) Notice: Subject to any disclaimer, the term of this patent is extended or adjusted under 35 U.S.C. 154(b) by 0 days.

(21) Appl. No.: 11/020,544

(22) Filed: Dec. 22, 2004

(65) Prior Publication Data

US 2006/0222520 A1 Oct. 5, 2006

(51) Int. Cl.
*F04B 49/03* (2006.01)

(52) U.S. Cl. ..... 417/306; 96/113; 417/440

(58) Field of Classification Search ..... 417/306, 417/307, 440
See application file for complete search history.

(56) References Cited

U.S. PATENT DOCUMENTS

| | | | | |
|---|---|---|---|---|
| 1,870,458 | A * | 8/1932 | Kenney | 62/196.3 |
| 2,301,034 | A * | 11/1942 | Freeman et al. | 417/306 |
| RE23,175 | E * | 11/1949 | Mantle | 417/295 |
| 3,043,496 | A * | 7/1962 | Glass et al. | 417/446 |
| 3,080,693 | A * | 3/1963 | Glass et al. | 96/113 |
| 3,844,688 | A | 10/1974 | Bulkley et al. | |
| 3,937,622 | A * | 2/1976 | Hewitt et al. | 96/113 |
| 4,781,209 | A * | 11/1988 | Nelander et al. | 96/133 |
| 4,887,514 | A | 12/1989 | Schintgen et al. | |
| 4,892,569 | A * | 1/1990 | Kojima | 96/113 |
| 4,902,226 | A * | 2/1990 | Elliott et al. | 417/372 |
| 5,171,130 | A | 12/1992 | Kume et al. | |
| 5,176,505 | A | 1/1993 | Horii et al. | |
| 6,010,314 | A | 1/2000 | Kobayashi et al. | |
| 6,113,367 | A | 9/2000 | Dunaevsky et al. | |
| 6,120,107 | A | 9/2000 | Eslinger | |
| 6,135,008 | A | 10/2000 | Soupal et al. | |
| 6,467,287 | B1 | 10/2002 | Sjoholm et al. | |

FOREIGN PATENT DOCUMENTS

| | | |
|---|---|---|
| DE | 3134169 | 3/1983 |
| FR | 929080 | 12/1947 |

OTHER PUBLICATIONS

Bendix, Service Data—SD-01-333; TU-FLO 550 Compressor; BW1639 2002, Bendix Commercial Vehicle Systems LLC; Apr. 2000; USA.

International Search Report & Written Opinion from PCT/2005/044207.

* cited by examiner

*Primary Examiner*—Michael Koczo, Jr.
(74) *Attorney, Agent, or Firm*—Calfee, Halter & Griswold LLP

(57) ABSTRACT

An apparatus for removing oil from air in an air compressor that has a piston reciprocable in a cylinder to compress the air, includes an oil removal chamber associated with the compressor. An unloader valve has an unactuated condition and an actuated condition disabling flow of compressed air out of the compressor and establishing fluid communication between the cylinder and the oil removal chamber. The apparatus may include an oil discharge port for draining oil from the oil removal chamber to a location away from the cylinder, and/or a filter element in the oil removal chamber.

42 Claims, 2 Drawing Sheets

AIR COMPRESSOR OIL RECIRCULATION SYSTEM

BACKGROUND OF THE INVENTION

1. Technical Field

The present invention relates to compressed air systems. In particular, the present invention relates to an air compressor that uses lubricating oil and to a method and apparatus for reducing migration of oil from the compressor to the compressed air output.

2. Description of the Prior Art

Air compressors using lubricating oil are commonly used in, for example, air brake systems of heavy vehicles. The compressor uses engine oil or another oil for internal lubrication. Some of this oil can undesirably migrate to the air brake system via the compressed air output of the compressor, a result sometimes referred to as oil-passing or oil carry-over. For example, in one known compressor, when the compressor is in the unloaded mode, the swept volume of the cylinder is open to a small chamber in the head of the compressor where air is compressed and expanded. Oil collects in this chamber, or drains back down into the cylinder and is carried into the air stream when the compressor loads.

SUMMARY OF THE INVENTION

The invention in one aspect relates to removing oil from air in an air compressor that has a piston reciprocable in a cylinder to compress the air. In one embodiment, an apparatus includes an oil removal chamber associated with the compressor, and an unloader valve having an unactuated condition and having an actuated condition disabling flow of compressed air out of the compressor and establishing fluid communication between the cylinder and the oil removal chamber. In one embodiment, an apparatus may include an oil discharge port for draining oil from the oil removal chamber to a location away from the cylinder, for example the crank case, and/or a filter element in the oil removal chamber. In another embodiment, a method of removing oil may be provided.

BRIEF DESCRIPTION OF THE DRAWINGS

The foregoing and other features of the present invention will become apparent to one skilled in the art to which the present invention relates upon consideration of the following description of the invention with reference to the accompanying drawings, in which.

DETAILED DESCRIPTION OF THE INVENTION

Figure 1:
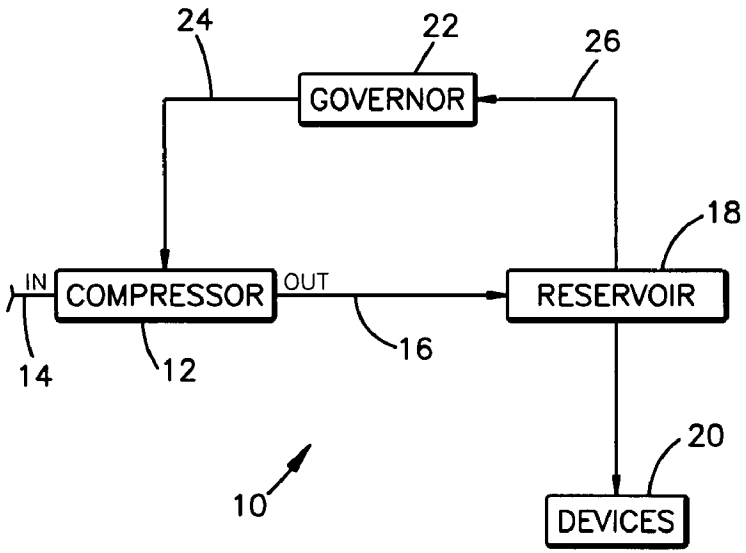
FIG. 1 is a schematic illustration of portions of a compressed air supply system for a vehicle, including a compressor and an oil recirculation system in accordance with one embodiment of the invention.

The present invention relates to compressed air systems. In particular, the present invention relates to an air compressor that uses lubricating oil and to a method and apparatus for preventing migration of oil from the compressor to the compressed air output. The present invention is applicable to air systems of differing constructions. As representative of the invention, FIG. 1 illustrates schematically an air system 10 that is a first embodiment of the invention.

The system 10 includes a compressor 12 for compressing inlet air from an inlet line 14. Compressed air from the compressor 12 flows through a discharge line 16 line to a reservoir 18. The reservoir 18 is connected to various system devices as shown schematically at 20, such as vehicle brake chambers, that use compressed air to operate. A governor 22 is operative to control operation (loading and unloading) of the compressor 12, in response to sensed pressure in a line 26 from the reservoir 18, via a control line 24.

Figure 2:
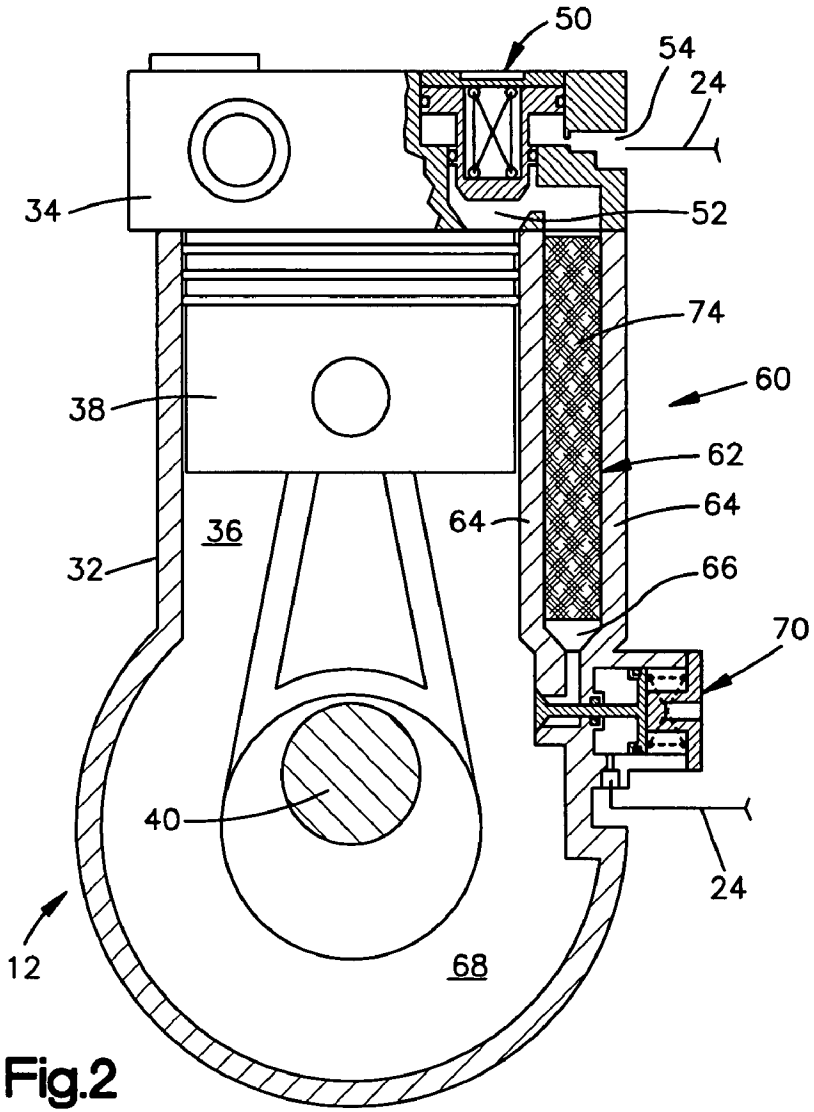
FIG. 2 is a schematic illustration of the compressor and oil recirculation system of FIG. 1.

FIG. 2 shows schematically the compressor 12 and an apparatus 60 for removing oil from the compressed air output of the compressor 12, being a first embodiment of the invention.

The compressor 14 includes a block 32 and a cylinder head 34. The cylinder head 34 includes portions not shown including an inlet passage connected with an inlet port, and a discharge passage connected with a discharge port. The inlet passage and the discharge passage are connected in fluid communication with the swept volume of a cylinder 36 in the block 32. A piston 38 is reciprocable in the cylinder 36, upon rotation of a crankshaft 40, to compress air flowing between the inlet port and the discharge port.

The compressor 12 has an unloader valve 50 that is normally closed. When the unloader valve 50 is closed, it blocks flow of air out of the cylinder 36 through an unloader passage 52, so that the air in the cylinder 36 can be compressed by the piston 38. The compressor 12 has an unloader port 54 for receiving an air pressure unloader signal over the control line 24, to open (actuate) the unloader valve 50. When the unloader valve 50 is actuated, in conjunction with operation of a discharge valve shut-off system, air can flow out of the cylinder 36 through the unloader passage 52, thus disabling the flow of compressed air out of the compressor to the vehicle braking system air even when the piston 38 continues to reciprocate. The unloader port 54 also communicates with a discharge port shut-off valve to shut off the discharge port when in the unloaded mode.

The compressor 12, including the piston 38 and cylinder 36, is lubricated by a lubricant (not shown) from a source, such as engine oil from the engine lubrication system 10. Typically a small amount of the lubricating oil flows out of the cylinder 36 (migrates) into the compressed air output of the compressor 12.

The system 10 includes an apparatus 60 for removing oil from the air in the system. In the illustrated embodiments, the apparatus 60 is shown as associated with the compressor 12; in other embodiments, the apparatus 60 could be located or associated elsewhere in the system 10.

The apparatus 60 includes an unloaded mode delivery chamber or oil removal chamber 62. The chamber 62 is a volume defined by chamber walls 64. The chamber 62 is in fluid communication with the unloader passage 52 when the unloader valve 50 is open as shown in FIG. 2. The chamber walls 64 may be formed as one piece with the compressor block 32, as shown in FIG. 2. Alternatively, the chamber walls 64 may be formed separately from the cylinder block 32.

A drain port or passage 66 at the bottom of the chamber 62 communicates with the compressor crank case 68. A condensed oil drain valve 70 is located between the oil removal chamber 62 and the compressor crank case 68. The valve 70 is controlled by an air pressure unloader signal from the governor 22 over the control line 24.

In the embodiment shown in FIG. 2, a filter element 74 is located in the chamber 62. The filter element 74 may be any element suitable for filtering or coalescing oil from air. A regenerative aluminum filter is one example.

When the pressure in the reservoir 18 is high enough that further supply of compressed air is not needed for the devices 20, the discharge valve of the compressor 12 is closed, and air pressure is applied at the unloader port 54, opening (actuating) the unloader valve 50. Air that would otherwise be compressed in the cylinder 36 and delivered out the discharge port is not so compressed. Instead, air from the cylinder 36 is, on the piston up-stroke, delivered to the oil removal chamber 62 via the unloader passage 52, which is open because of the opening of the unloader valve 50. The air flows into the oil removal chamber 62.

As the air expands into the oil removal chamber 62, it cools. Some of the oil in the air condenses out and collects in the chamber 62. The chamber 62 is preferably maintained at a lower temperature than the cylinder 36, by being external to the cylinder. This can aid in the condensing of the oil. In addition, oil in the air can be filtered, that is, physically captured by the filter element 74. On the piston down stroke of the piston 38, the air in the chamber 62 expands back into the cylinder 36. This process repeats with each cycle of the piston 38.

When the compressor 12 is thus in the unloaded mode, the pressure in the oil removal chamber 62 cycles constantly, at the frequency of the compressor operation, from one atmosphere to about 4–6 atmospheres.

In this manner, at least a portion of the oil is removed from the air that is discharged from the cylinder 36 on the piston up-stroke. This can reduce or minimize the amount of oil that migrates into the air flowing into the downstream parts of the system 10.

When the compressor 12 is in the loaded mode, the unloader valve 50 is closed and compressed air is delivered out of the discharge port. During the loaded cycle, oil that was entrained in the filter 74, as well as oil collected in the chamber 62, can drain back into the crank case 68. Specifically, when the compressor 12 is loaded, the unloader valve 50 is closed and the drain valve 70 is opened. Oil collected in the chamber 62 is allowed to drain from the chamber to the compressor crank case 68.

Figure 4:
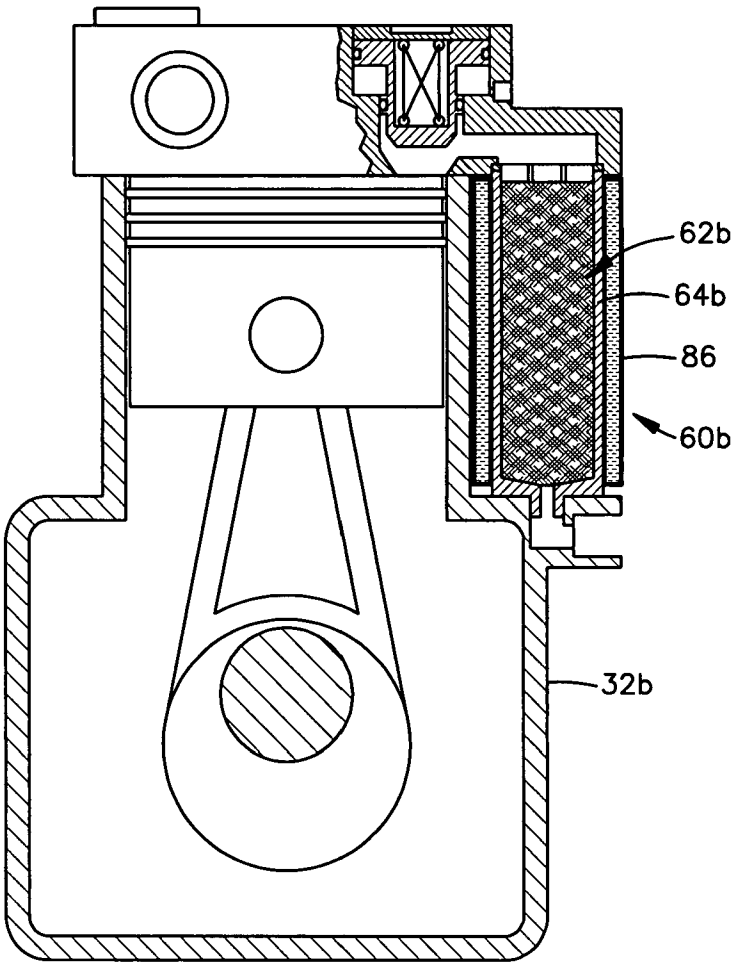
FIG. 4 is a schematic illustration of an oil recirculation system that is still another embodiment of the invention.
Figure 3:
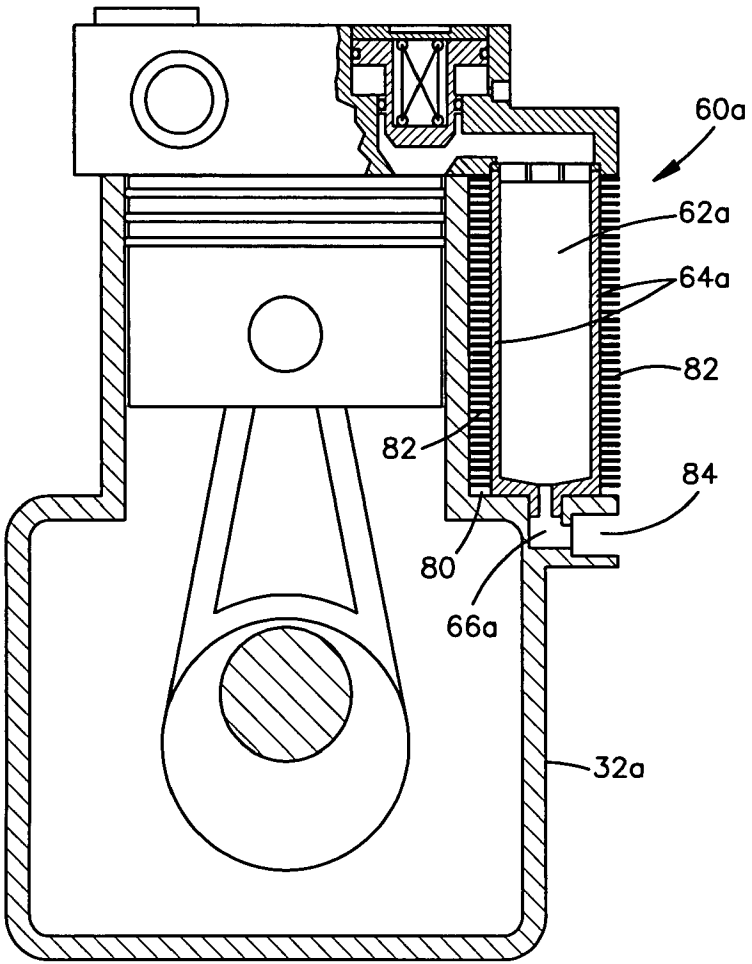
FIG. 3 is a schematic illustration of an oil recirculation system that is another embodiment of the invention.

FIGS. 3 and 4 illustrate oil removal apparatus 60 that are other embodiments of the invention. Features or alternatives shown in these embodiments can be substituted for or combined with, in any suitable combination, features of the embodiment of FIG. 2.

FIG. 3 illustrates an oil removal apparatus 60*a* associated with a compressor 12*a*. Parts of the apparatus 60*a* and the compressor 12*a* that are the same as, or similar to, parts of the apparatus 60 and compressor 12, are given the same reference numerals with the suffix "a" attached.

In the embodiment of FIG. 3, the oil removal chamber 62*a* is defined by walls 64*a* that are formed separately from the compressor block 32*a*. In addition, the chamber walls 64*a* are spaced apart from the cylinder block 32*a* to define a space or air gap 80 between them. This air gap 80 helps to cool the chamber 62*a*. Further, the chamber walls 64*a* are provided with cooling fins 82 to help promote cooling of the chamber 62*a*. Greater temperature differential between the chamber 62*a* and the cylinder 36*a* can help to increase oil removal.

The apparatus 60*a* also includes an oil drain passage 66*a* that does not connect the chamber 62*a* with the compressor crank case 68*a*. Rather, the oil drain passage 66*a* opens to a port 84 on the exterior of the compressor 12*a*. An oil line (not shown) can be connected to the port 84 to deliver removed oil back to the lubrication system from which it came, for example, the engine lubrication system.

FIG. 4 illustrates an oil removal apparatus 60*b* associated with a compressor 12*b*. Parts of the apparatus 60*b* and the compressor 12*b* that are the same as, or similar to, parts of the apparatus 60 and compressor 12, are given the same reference numerals with the suffix "b" attached.

In the embodiment of FIG. 4, the oil removal chamber 62*b* is defined by walls 64*b* that are formed separately from the compressor block 32*b*. In addition, the walls 64*b* are spaced apart from the cylinder block 32*b*. A water jacket 86 at least partially surrounds the chamber walls 64*b*. The water jacket 86 can be connected with the cooling system of the compressor 12 itself. The water jacket 86 helps to cool the chamber 62*b*. The water jacket 86 is one example of a cooling system that can be used.

From the above description of the invention, those skilled in the art will perceive improvements, changes, and modifications in the invention. Such improvements, changes, and modifications within the skill of the art are intended to be included within the scope of the appended claims.

I claim:

1. An apparatus for removing oil from air in an air compressor that has a piston reciprocable in a cylinder to compress the air, the apparatus comprising:

an oil removal chamber associated with the compressor;

an unloader valve having an unactuated condition and having an actuated condition disabling flow of compressed air out of the compressor and establishing fluid communication between the cylinder and the oil removal chamber; and an oil discharge port for draining oil from the oil removal chamber to a location away from the cylinder.

2. An apparatus as set forth in claim 1 including a filter element in the oil removal chamber.

3. An apparatus as set forth in claim 1 wherein the oil discharge port drains oil away from the compressor.

4. An apparatus as set forth in claim 1 wherein the oil discharge port drains oil into a crank case of the compressor.

5. An apparatus as set forth in claim 4 including an oil drain valve at the oil discharge port, the oil drain valve being controlled by an air pressure signal.

6. An apparatus as set forth in claim 5 wherein the oil drain valve is controlled by the same air pressure signal as the unloader valve, the oil drain valve being opened when the unloader valve is closed, and the oil drain valve being closed when the unloader valve is opened.

7. An apparatus as set forth in claim 1 including chamber walls defining the oil removal chamber and connected with the compressor to make the oil removal chamber integral with the compressor.

8. An apparatus as set forth in claim 7 including an air gap between the compressor and the chamber walls for helping to cool the chamber.

9. An apparatus as set forth in claim 8 including cooling fins on the chamber walls for helping to cool the chamber.

10. An apparatus as set forth in claim 7 including a water jacket between the compressor and the chamber walls for helping to cool the chamber.

11. An apparatus as set forth in claim 7 wherein the chamber walls are formed with a cylinder block of the compressor.

12. Apparatus for removing oil from air in an air compressor that has a piston reciprocable in a cylinder to compress the air and that has a loaded mode and an unloaded mode, the apparatus comprising:

an oil removal chamber that can be selectively placed in fluid communication with the cylinder;

means for placing the compressor in the unloaded mode;

means for establishing fluid communication between the oil removal chamber and the cylinder when the compressor is in the unloaded mode; and drain means for draining oil from the chamber to a location away form the cylinder.

13. Apparatus as set forth in claim 12 further including filter means in the chamber for filtering oil from air in the chamber.

14. Apparatus as set forth in claim 12 wherein the drain means is operative to drain oil from the chamber into a crank case of the compressor.

15. Apparatus as set forth in claim 12 wherein the drain means is operative to drain oil from the chamber to a location away from the compressor.

16. Apparatus as set forth in claim 12 wherein the drain means includes an oil drain valve and wherein the means for placing the compressor in an unloaded mode comprises an unloader valve that is operated by the same control signal as the oil drain valve.

17. Apparatus as set forth in claim 12 further comprising means for cooling the oil removal chamber.

18. Apparatus as set forth in claim 17 wherein the means for cooling comprises a water jacket.

19. Apparatus as set forth in claim 17 wherein the means for cooling comprises cooling fins on chamber walls of the chamber.

20. A compressor for a vehicle air system, comprising:

a block defining a cylinder;

a piston reciprocable in the cylinder;

an unloader mechanism for selectively placing the compressor in an unloaded mode; and an unloaded mode delivery chamber connected in fluid communication with the cylinder, by the unloader mechanism, for receiving air from the cylinder when the compressor is in the unloaded mode, the chamber having a discharge port for draining oil from the chamber to a location away from the cylinder.

21. A compressor as set forth in claim 20 having a crank case and comprising an oil return passage between the delivery chamber and the crank case.

22. A compressor as set forth in claim 21 further including a drain valve in the oil return passage for selectively controlling drainage of oil from the oil removal chamber to the crank case.

23. A compressor as set forth in claim 20 comprising an oil return passage for returning oil from the delivery chamber to the compressor.

24. A compressor as set forth in claim 20 further comprising a filter in the chamber for filtering oil from the air flowing into the chamber.

25. A compressor as set forth in claim 20 including an insulation air gap between the chamber and the cylinder block to promote cooling.

26. A compressor as set forth in claim 20 wherein the chamber has cooling fins.

27. A compressor as set forth in claim 20 wherein the chamber is integrated into the cylinder block of the compressor.

28. A compressor as set forth in claim 3 wherein the compressor has a liquid cooling system that includes a water jacket around the chamber to promote cooling of the chamber.

29. A method of removing oil from air in an air compressor that has a piston reciprocable in a cylinder to compress the air, the method comprising the steps of:

unloading the compressor;

removing oil from the air in the compressor when the compressor is unloaded; and draining the removed oil to a location away from the cylinder.

30. A method as set forth in claim 29 wherein the step of removing oil comprises removing oil with a filter that is disposed in an air removal chamber.

31. A method as set forth in claim 29 wherein the step of draining oil comprises draining oil to a crank case of the compressor.

32. A method as set forth in claim 29 wherein the step of draining oil comprises draining oil to a location remote from the compressor.

33. A vehicle air system comprising:

a compressor having an a piston reciprocable in a cylinder to compress air and having an unloader mechanism;

a reservoir connected with the compressor by a discharge line;

systems devices of the vehicle air system that use compressed air to operate;

a governor operative to control the unloading mechanism of the compressor in response to sensed pressure in the reservoir;

the compressor including an unloaded mode delivery chamber connected in fluid communication with the cylinder, by the unloader mechanism, for receiving air from the cylinder when the compressor is in the unloaded mode, the chamber having a discharge port for draining oil from the chamber to a location away from the cylinder.

34. A system as set forth in claim 33 wherein the compressor has a crank case and an oil return passage between the delivery chamber and the crank case.

35. A compressor as set forth in claim 34 further including a drain valve in the oil return passage for selectively controlling drainage of oil from the oil removal chamber to the crank case.

36. A compressor as set forth in claim 33 further comprising a filter in the chamber for filtering oil from the air flowing into the chamber.

37. An apparatus for removing oil from air in an air compressor that has a piston reciprocable in a cylinder to compress the air, the apparatus comprising:

an oil removal chamber associated with the compressor;

a filter element in the oil removal chamber; and an unloader valve having an unactuated condition and having an actuated condition disabling flow of compressed air out of the compressor and establishing fluid communication between the cylinder and the oil removal chamber.

38. An apparatus as set forth in claim 37 wherein the filter element is a regenerative aluminum filter.

39. Apparatus as set forth in claim 37 further including an oil discharge port for draining oil from the oil removal chamber to a location away from the cylinder.

40. An apparatus as set forth in claim 39 wherein the oil discharge port drains oil away from the compressor.

41. An apparatus as set forth in claim 39 wherein the oil discharge port drains oil into a crank case of the compressor.

42. An apparatus as set forth in claim 41 including an oil drain valve at the oil discharge port, the oil drain valve being controlled by the same air pressure signal as the unloader valve, the oil drain valve being opened when the unloader valve is closed, and the oil drain valve being closed when the unloader valve is opened.

* * * * *